US006642643B2

(12) United States Patent
Cohee et al.

(10) Patent No.: US 6,642,643 B2
(45) Date of Patent: Nov. 4, 2003

(54) SILICATE MATERIALS FOR CATHODE-RAY TUBE (CRT) APPLICATIONS

(75) Inventors: Gregory James Cohee, Newtown, PA (US); Liyou Yang, Plainsboro, NJ (US); Philip Michael Heyman, West Windsor, NJ (US)

(73) Assignee: Thomson Licensing S.A., Boulogne Cedex (FR)

( * ) Notice: Subject to any disclaimer, the term of this patent is extended or adjusted under 35 U.S.C. 154(b) by 468 days.

(21) Appl. No.: 09/741,541

(22) Filed: Dec. 20, 2000

(65) Prior Publication Data

US 2002/0074924 A1 Jun. 20, 2002

(51) Int. Cl.[7] ..... H01J 29/80

(52) U.S. Cl. ..... 313/402; 313/407; 313/408; 445/37

(58) Field of Search ..... 313/402, 403, 313/408, 355, 407, 414, 409, 479; 445/37, 67, 68

(56) References Cited

U.S. PATENT DOCUMENTS 3,668,002 A * 6/1972 Okabe et al. ..... 427/124
5,594,300 A * 1/1997 Nosker et al. ..... 313/402
5,613,889 A * 3/1997 Nosker et al. ..... 445/37
5,625,251 A * 4/1997 Nosker et al. ..... 313/403
5,629,051 A * 5/1997 Poliniak ..... 427/475
5,644,192 A * 7/1997 Ragland, Jr. ..... 313/402
5,646,478 A * 7/1997 Nosker et al. ..... 313/402
5,647,653 A * 7/1997 Cherukuri ..... 313/402
5,952,774 A * 9/1999 Diven et al. ..... 313/402
6,084,342 A * 7/2000 Ragland, Jr. ..... 313/407
6,157,121 A * 12/2000 Ragland et al. ..... 313/403

* cited by examiner

*Primary Examiner*—Jay Patidar
(74) *Attorney, Agent, or Firm*—Joseph S. Tripoli; Carlos M. Herrera; Richard LaPeruta, Jr.

(57) ABSTRACT

A color cathode-ray tube (CRT) has an evacuated envelope with an electron gun therein for generating at least one electron beam. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially parallel to the phosphor elements on the screen. Each of the first conductive strands has a substantially continuous insulating material layer formed on a screen facing side thereof. A plurality of second conductive wires are oriented substantially perpendicular to the plurality of first conductive strands and are bonded thereto by the insulating material layer. The insulating material layer is composed of a silicate material.

15 Claims, 4 Drawing Sheets

SILICATE MATERIALS FOR CATHODE-RAY TUBE (CRT) APPLICATIONS

BACKGROUND OF THE INVENTION

1. Field of the Invention

This invention relates to a color cathode-ray tube (CRT) and, more particularly to a color CRT having a focus mask.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT tube. The screen has an array of three different color-emitting phosphors (e.g., green, blue, red) formed thereon. The aperture mask functions to direct electron beams generated in the electron gun toward appropriate color emitting phosphors on the screen of the CRT tube.

The aperture mask may be a focus mask. Focus masks typically comprise two sets of conductive lines (or wires) that are arranged approximately orthogonal to each other, to form an array of openings. Different voltages are applied to the two sets of conductive lines so as to create multipole focusing lenses in each opening of the mask. The multipole focusing lenses are used to direct the electron beams toward the color-emitting phosphors on the screen of the CRT tube.

One type of focus mask is a tensioned focus mask, wherein at least one of the two sets of conductive lines is under tension. Typically, for tensioned focus masks, the vertical set of conductive lines is under tension, with the horizontal set of conductive lines overlying such vertical tensioned lines.

Where the two sets of conductive lines overlap, such conductive lines are typically attached to their crossing points (junctions) by an insulating material. When the different voltages are applied between the two sets of conductive lines of the mask, to create the multipole focusing lenses in the openings thereof, high voltage (HV) flashover may occur at one or more junction. HV flashover is the dissipation of an electrical charge across the insulating material separating the two sets of conductive lines. HV flashover is undesirable because it may cause an electrical short circuit between the two sets of conductive lines leading to the subsequent failure of the focus mask.

Also, when the electron beams from the electron gun are directed toward the color emitting phosphors on the screen, backscattered electrons from the screen may cause the insulator material on the focus mask to accumulate an electrical charge. Such charging is undesirable because it may interfere with the ability of the focus mask to direct the electron beams toward the color emitting phosphors formed on the screen, as well as cause HV flashover between the two sets of conductive lines of the focus mask.

Thus, a need exists for insulating materials that overcome the above-mentioned drawbacks.

SUMMARY OF THE INVENTION

The present invention relates to a color cathode-ray tube (CRT) having an evacuated envelope with an electron gun therein for generating at least one electron beam. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially aligned with the phosphor elements on the screen. Each of the first conductive strands has a substantially continuous insulating material layer formed on a screen facing side thereof. A plurality of second conductive strands are oriented substantially perpendicular to the plurality of first conductive strands and are bonded thereto by the insulating material layer. The insulating material layer is a silicate material.

BRIEF DESCRIPTION OF THE DRAWING

The invention will now be described in greater detail, with relation to the accompanying drawing, in which.

DETAILED DESCRIPTION OF THE PREFERRED EMBODIMENT

Figure 1:
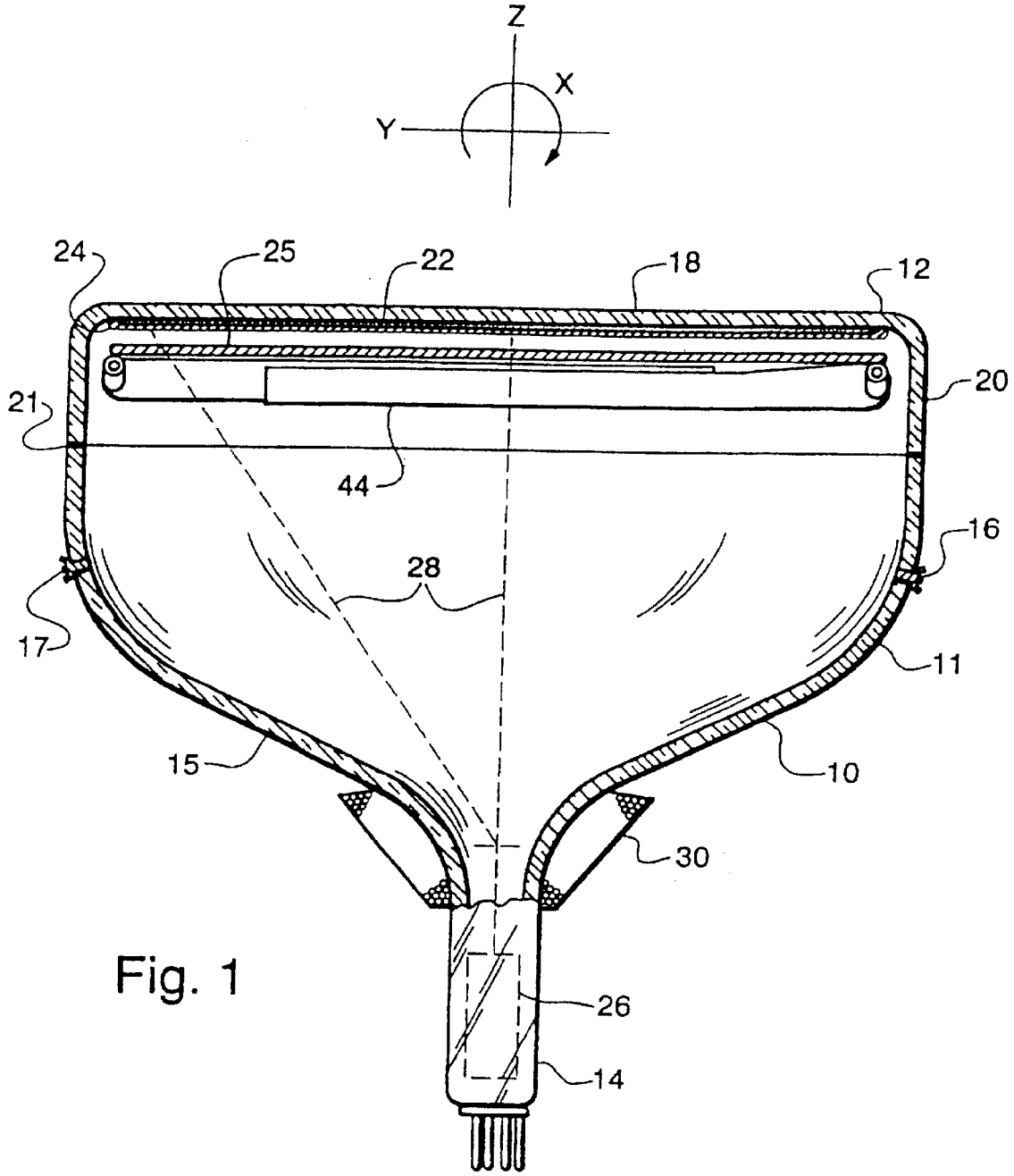
FIG. 1 is a plan view, partly in axial section, of a color cathode-ray tube (CRT) including a focus mask-frame assembly embodying the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, a first anode button 16 to the neck 14. A second anode button 17, located opposite the first button 16, is not contacted by the conductive coating.

The faceplate panel 12 comprises a viewing faceplate 18 and a peripheral sidewall 20, or skirt, that is sealed to the funnel 15 by a glass frit 21. A three-color luminescent screen 22 of phosphor elements is coated onto the inner surface of the faceplate 18. The screen 22 is a line screen, shown in detail in FIG. 5, that includes a multiplicity of screen elements comprising red-emitting, green-emitting, and blue-emitting phosphor elements, R, G, and B, respectively, arranged in triads, each triad including a phosphor line of each of the three colors. Preferably, a light absorbing matrix 23 separates the phosphor elements. A thin conductive layer 24, preferably made of aluminum, overlies the screen 22 on the side away from the faceplate 18, and provides means for applying a uniform first anode potential to the screen as well as for reflecting light, emitted from the phosphor elements, through the faceplate 18.

A cylindrical multi-aperture color selection electrode, or focus mask 25, is removably mounted, by conventional means, within the faceplate panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the focus mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams to magnetic fields that cause the beams to horizontally and vertically scan a rectangular raster across the screen 22.

The focus mask 25 is formed, preferably, from a thin rectangular sheet of about 0.55 mm (2 mils) thick low carbon steel (about 0.005% carbon by weight). Suitable materials for the focus mask 25 may include high expansion, low carbon steels having a coefficient of thermal expansion (CTE) within a range of about 120–160×$10^{-7}$/° C.; intermediate expansion alloys such as, iron-cobalt-nickel (e.g., KOVAR™) having a coefficient of thermal expansion within a range of about 40–60×$10^{-7}$/° C.; as well as low expansion alloys such as, iron-nickel (e.g., INVAR™) having a coefficient of thermal expansion within a range of about 9–30×$10^{-7}$/° C.

Figure 2:
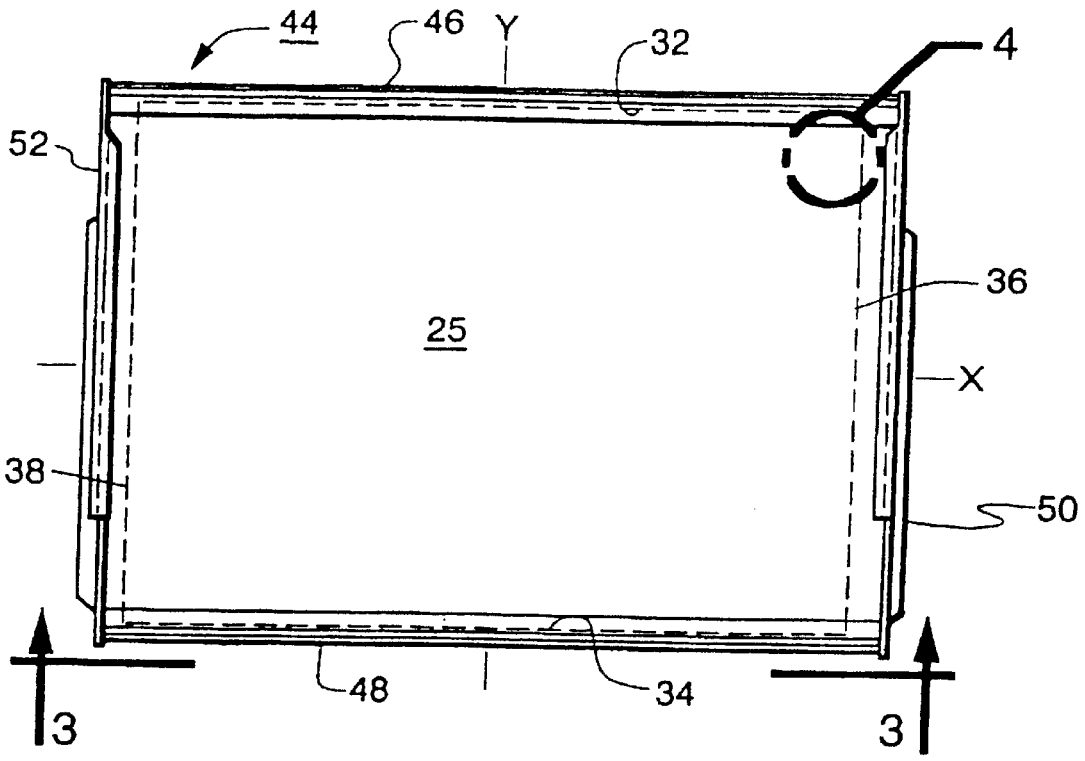
FIG. 2 is a plan view of the focus mask-frame assembly of FIG. 1.

As shown in FIG. 2, the focus mask 25 includes two horizontal sides 32, 34 and two vertical sides 36, 38. The two horizontal sides 32, 34 of the focus mask 25 are parallel with the central major axis, X, of the CRT while the two vertical sides 36, 38 are parallel with the central axis, Y, of the CRT.

Figure 4:
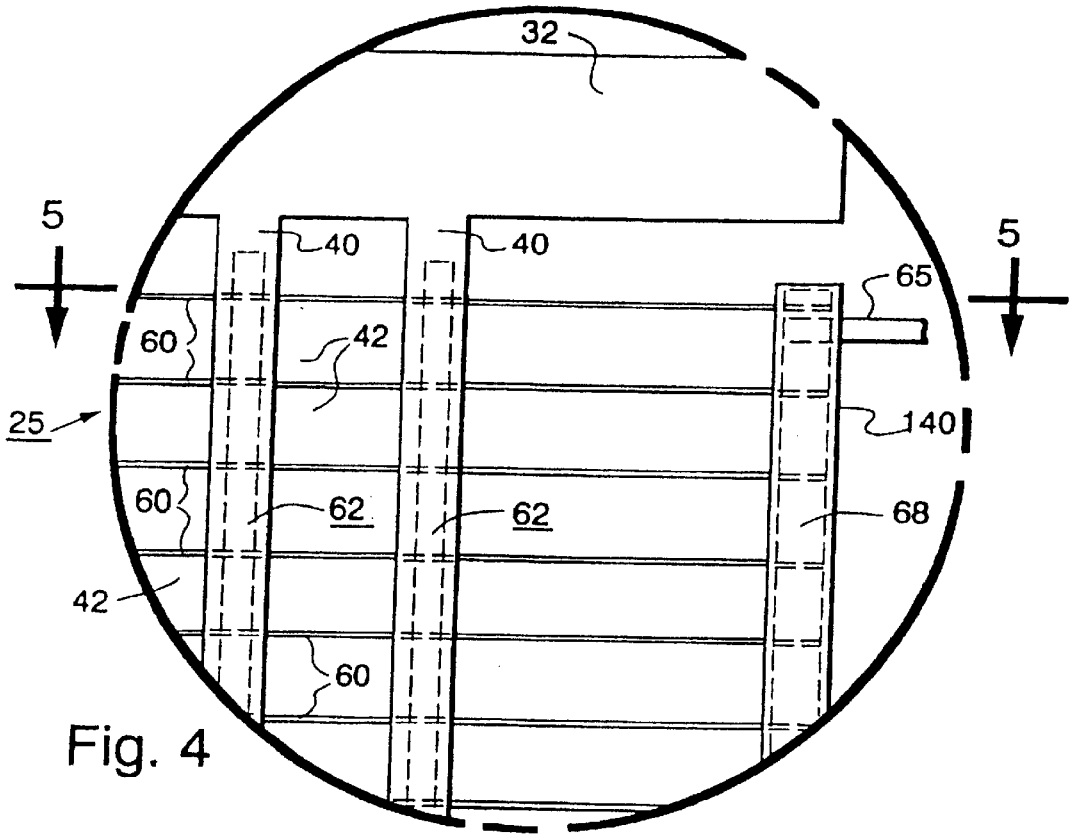
FIG. 4 is an enlarged section of the focus mask shown within the circle 4 of FIG. 2.

The focus mask 25 (shown schematically by the dashed lines in FIG. 2) includes an apertured portion that is adjacent to and overlies an effective picture area of the screen 22. Referring to FIG. 4, the focus mask 25 includes a plurality of the first conductive metal strands 40 (conductive wires), each having a transverse dimension, or width, of about 0.3 mm to about 0.5 mm (12–20 mils) separated by spaced apertures 42, each having a width of about 0.27 mm to about 0.43 mm (11–16 mils) that parallel the minor axis, Y, of the CRT and the phosphor elements of the screen 22. For a color CRT having a diagonal dimension of 68 cm, the first metal strands have widths in a range of about 0.3 mm to about 0.38 mm (12–14.5 mils) and an aperture 42 width of about 0.27 mm to about 0.33 mm (11–13.3 mils). In a color CRT having a diagonal dimension of 68 cm (27 V), there are about 760 of the first metal strands 40. Each of the apertures 42 extends from one horizontal side 32 of the mask to the other horizontal side 34 thereof (not shown in FIG. 4).

Figure 3:
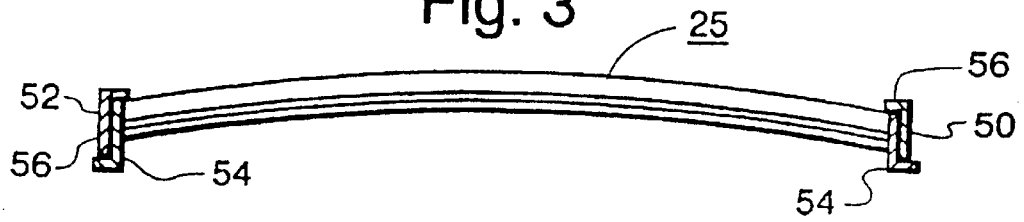
FIG. 3 is a front view of the mask-frame assembly taken along line 3—3 of FIG. 2.

A frame 44, for the focus mask 25, is shown in FIGS. 1–3, and includes four major members, two torsion tubes or curved members 46, 48 and two tension arms or straight members 50, 52. The two curved members 46, 48 are parallel to the major axis, X, and each other.

As shown in FIG. 3, each of the straight members 50, 52, includes two overlapped partial members or parts 54, 56, each part having an L-shaped cross-section. The overlapped parts 54, 56 are welded together where they are overlapped. An end of each of the parts 54, 56 is attached to an end of one of the curved members 46, 48. The curvature of the curved members 46, 48 matches the cylindrical curvature of the focus mask 25. The horizontal sides 32, 34 of the focus mask 25 are welded between the two curved members 46, 48, which provides the necessary tension to the mask. Before welding the horizontal sides 32, 34 of the focus mask 25 to the frame 44, the mask material is pre-stressed and blackened by tensioning the mask material while heating it, in a controlled atmosphere of nitrogen and oxygen, at a temperature of about 500° C., for about 120 minutes. The frame 44 and the mask material, when welded together, comprise a mask assembly.

Figure 5:
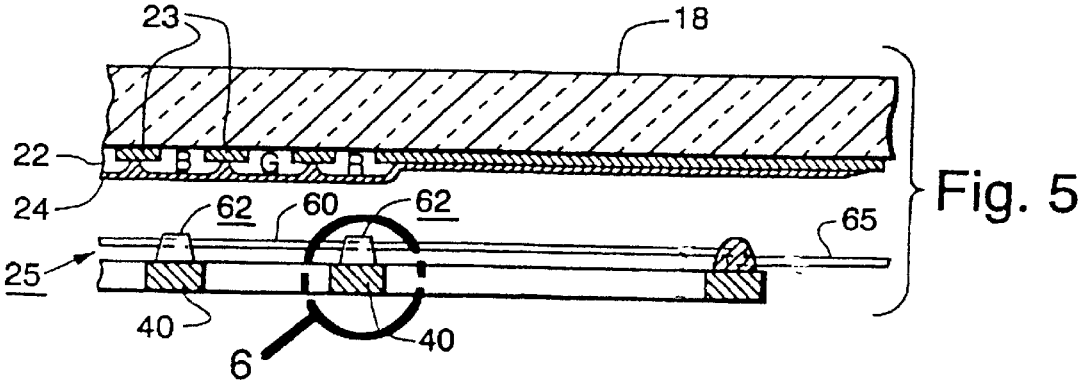
FIG. 5 is a view of the focus mask and the luminescent screen taken along lines 5—5 of FIG. 4.

With reference to FIGS. 4 and 5, a plurality of second conductive metal wires (cross wires) 60, each having a diameter of about 0.025 mm (1 mil), are disposed substantially perpendicular to the first metal strands 40 and are spaced therefrom by an insulator 62, formed on the screen-facing side of each of the first metal strands 40. The second metal wires 60 form cross members that facilitate the application of a second anode, or focusing, potential to the focus mask 25. Suitable materials for the second metal wires include iron-nickel alloys such as INVAR™ and/or high-nickel steels such as HyMu80 wire (commercially available from Carpenter Technology, Reading, Pa.).

The vertical spacing, or pitch, between adjacent second metal wires 60 is about 0.33 mm (13 mils) for a color CRT having a diagonal dimension of 68 cm (27 V). The relatively thin second metal wires 60 (as compared to the first metal strands 40) provide the essential focusing function of the focus mask 25, without adversely affecting the electron beam transmission thereof. The focus mask 25, described herein, provides a mask transmission, at the center of the screen 22, of about 40–45%, and requires that the second anode, or focussing, voltage, •V, applied to the second metal wires 60, differs from the first anode voltage applied to the first metal strands 40 by less than about 1 kV, for a first anode voltage of about 30 kV.

The insulators 62, shown in FIG. 4, are disposed substantially continuously on the screen-facing side of each of the first metal strands 40. The second metal wires 60 are bonded to the insulators 62 to electrically isolate the second metal wires 60 from the first metal strands 40.

The insulators 62 are formed of a suitable material that has a thermal expansion coefficient that is matched to the material of the focus mask 25. The material of the insulators should preferably have a relatively low melting temperature so that it may flow, harden, and adhere to both the first metal strands 40 and second wires 60, within a temperature range of about 450° C. to about 500° C. The insulator material should also preferably have a dielectric breakdown strength of about 40000 V/mm (1000 V/mil), with bulk and surface electrical resistivities of about $10^{11}$ ohm-cm and $10^{12}$ ohm/square, respectively. Additionally, the insulator material should be stable at temperatures used for sealing the CRT faceplate panel 12 to the funnel (temperatures of about 450° C. to about 500° C.), as well as having adequate mechanical strength and elastic modulus, and be low outgassing during processing and operation for an extended period of time under electron beam bombardment.

The insulators 62 are formed of a silicate material. The silicate material is an inert coating comprised mostly of silicon and oxygen, with some residual organic substituents therein.

The silicate material is formed from the thermal decomposition of a silicone resin. Suitable silicone resins include, for example, silsesquioxane compounds such as polymethylsilsesquioxane and polyphenylsilsesquioxane. The silicone resin may be dispersed in one or more solvents. Suitable solvents include for example, methyl isobutyl ketone (MIBK) and isopropyl alcohol (IPA).

Additionally, fillers such as, for example, silica, can be mixed with the silicone resins. The ratio of the filler material to the silicone resin is used to control the thermal/mechanical properties of the insulators 62. The ratio of the filler material to the silicone resin is preferably greater than about 2:1.

Figure 6:
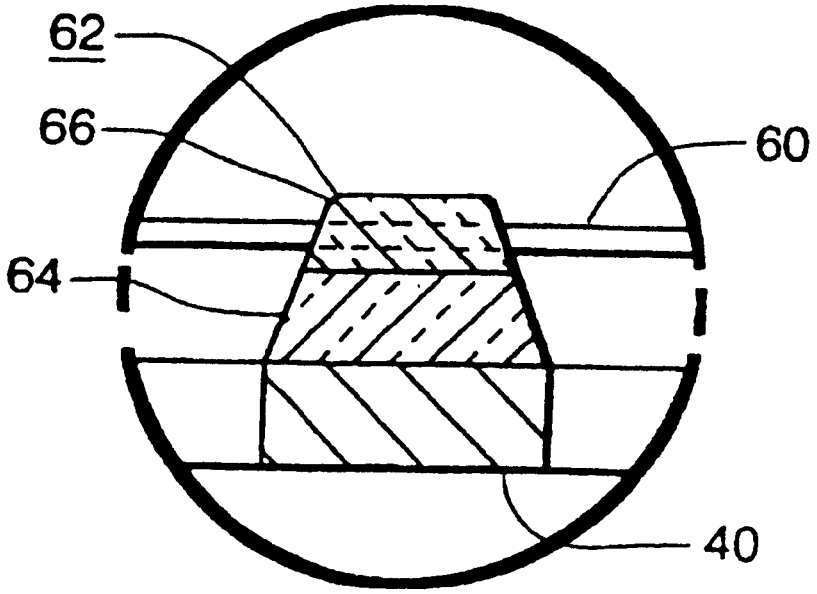
FIG. 6 is an enlarged view of a portion of the focus mask shown within the circle 6 of FIG. 5.

According to a preferred method of making the focus mask 25, and referring to FIG. 6, a first coating of the insulator 64 is provided, e.g., by spraying, onto the screen-facing side of the first metal strands 40. The first metal strands 40, in this example, are formed of a low expansion alloy, such as INVAR™, having a coefficient of thermal expansion within the range of 9–30×$10^{-7}$/° C. The first insulator coating 64, for example, may comprise a 1:1 mixture of polymethylsilsesquioxane and polyphenylsilsesquioxane resins suspended in a 1:1 solution of MIBK and IPA. A silica filler is added to the suspension in a filler:silicone ratio of about 3:1. The first coating of the insulator 64 typically has a thickness of about 0.05 mm to about 0.09 mm (2–3.5 mils).

The frame 44, including the coated first metal strands 40, is air dried. After the first coating of the insulator material 64 is dried, second metal wires 60 are applied to the frame 44, such that the second metal wires 60 are substantially perpendicular to the first metal strands 40. The second metal wires 60 are applied using a winding fixture (not shown) that accurately maintains a desired spacing of, for example, about 0.33 mm (13 mils) between adjacent metal strands for a color CRT having a diagonal dimension of about 68 cm (27 V).

Subsequent to winding the second metal wires 60 onto the frame 44, a coating of the solvents (e.g., MIBK and/or IPA) used to apply the silicone resins is sprayed over the second metal wires 60. The solvent is used to partially re-dissolve the first coating of the insulator 64 causing it to wick over the second metal wires 60, attaching them thereto.

The frame 44, including the winding fixture, is optionally heated to a temperature of about 200° C. for about 30–120 minutes, to stabilize the insulator material 64 and bond the second metal wires 60 thereto. After the insulators 62 are dried, a semiconducting cap layer (not shown) may be formed over the plurality of second conductive wires 60 and insulators 62 using a plasma enhanced chemical vapor deposition (PECVD) process. The semiconducting cap layer is used to prevent charge accumulation on the insulating material layer. The semiconducting cap layer preferably has a sheet resistance within a range of about $10^{11}$ ohm/square to about $10^{14}$ ohm/square. The cap layer preferably has a thickness within a range of about 100 Å to about 500 Å.

A suitable semiconducting material layer is silicon carbide. The silicon carbide may be a doped silicon carbide layer. The dopants increase the number of free carriers in the semiconducting material, thereby controlling conductivity thereof. Suitable dopants include Group III and Group V elements such as, for example, phosphorous (P), boron (B), aluminum (Al), and arsenic (As), among others.

After the semiconducting cap layer is formed on the insulators 62, the frame 44 is taken out of the holding device, electrical connections are made to the first strands 40 and second strands 60, and the focus mask 25 is inserted into a tube envelope. Thereafter, during a subsequent frit seal cycle at temperatures of about 450° C., the silicone resins are thermally decomposed into the silicate material.

Alternatively, other insulator materials such as, for example, lead-zinc borosilicate glasses, may be used in conjunction with the silicate insulators, described therein. For example, a lead-zinc borosilicate glass material may be used for the first coating of the insulator material 64 and the silicate insulator may be applied thereover as a second coating of the insulator material 66, followed by the application of a semiconducting cap layer (not shown).

What is claimed:

1. A cathode-ray tube comprising an evacuated envelope having therein an electron gun for generating an electron beam, a faceplate panel having a luminescent screen with phosphor elements on an interior surface thereof, and a focus mask, wherein the focus mask includes a plurality of spaced-apart first conductive strands having an insulating material thereon, and a plurality of spaced-apart second conductive wires oriented substantially perpendicular to the plurality of spaced-apart first conductive strands, the plurality of spaced-apart second conductive wires being bonded to the insulating material, wherein the insulating material comprises a silicate material.

2. The cathode-ray tube of claim 1 wherein the silicate material is formed from the thermal decomposition of a silicone resin.

3. The cathode-ray tube of claim 2 wherein the silicone resin is mixed with a filler material.

4. The cathode-ray tube of claim 2 wherein the silicone resin is a silsesquioxane compound.

5. The cathode-ray tube of claim 4 wherein the silsesquioxane compound is selected from the group consisting of polymethylsilsesquioxane, polyphenylsilsesquioxane, and combinations thereof.

6. The cathode-ray tube of claim 3 wherein the filler material is silica.

7. The cathode-ray tube of claim 3 wherein the ratio of the filler material to the silicone resin is greater than about 2:1.

8. A method of manufacturing a cathode-ray tube comprising an evacuated envelope having therein an electron gun for generating an electron beam, a faceplate panel having a luminescent screen with phosphor elements on an interior surface thereof, and a focus mask, wherein the focus mask includes a plurality of spaced-apart first conductive strands, and a plurality of spaced-apart second conductive wires oriented substantially perpendicular to the plurality of spaced-apart first conductive strands, comprising:

forming an insulating material on the plurality of spaced-apart first conductive strands, wherein the insulating material comprises a silicate material.

9. The method of claim 8 wherein the silicate material is formed from the thermal decomposition of a silicone resin.

10. The method of claim 9 wherein the silicone resin is mixed with a filler material.

11. The method of claim 9 wherein the silicone resin is a silsesquioxane compound.

12. The method of claim 11 wherein the silsesquioxane compound is selected from the group consisting of polymethylsilsesquioxane, polyphenylsilsesquioxane, and combinations thereof.

13. The method of claim 10 wherein the filler material is silica.

14. The method of claim 10 wherein the ratio of the filler material to the silicone resin is greater than about 2:1.

15. The method of claim 8, further comprising bonding the plurality of spaced-apart second conductive wires to the insulating material.

* * * * *